US009534333B2

(12) United States Patent
Lee et al.

(10) Patent No.: US 9,534,333 B2
(45) Date of Patent: Jan. 3, 2017

(54) DRUM TYPE WASHING MACHINE

(71) Applicant: Dongbu Daewoo Electronics Corporation, Seoul (KR)

(72) Inventors: Ju Dong Lee, Seoul (KR); Jeong Hyeon Kim, Seoul (KR); In Dong Kim, Seoul (KR); Hye Ung Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 279 days.

(21) Appl. No.: 14/170,452

(22) Filed: Jan. 31, 2014

(65) Prior Publication Data

US 2015/0176180 A1 Jun. 25, 2015

(30) Foreign Application Priority Data

Dec. 23, 2013 (KR) ..... 10-2013-0161019

(51) Int. Cl.
*D06F 37/04* (2006.01)
*D06F 37/30* (2006.01)

(52) U.S. Cl.
CPC ..... *D06F 37/04* (2013.01); *D06F 37/30* (2013.01)

(58) Field of Classification Search
CPC ..... D06F 37/02; D06F 37/04; D06F 37/30; D06F 58/04
See application file for complete search history.

(56) References Cited

U.S. PATENT DOCUMENTS 5,463,883 A * 11/1995 Pellerin ..... D06F 37/00 277/361
5,862,687 A * 1/1999 Jang ..... D06F 37/065 68/142
6,588,238 B1 * 7/2003 Reason ..... D06F 37/04 68/142
8,161,777 B2 * 4/2012 Loss ..... D06F 37/04 68/140
2002/0157430 A1 * 10/2002 Ren ..... D06F 37/04 68/140

(Continued)

FOREIGN PATENT DOCUMENTS

KR 20010088211 11/2002
KR 20030060551 8/2004
KR 20100057114 5/2010

OTHER PUBLICATIONS

Korean Notice of Allowance dated May 18, 2015 issued in corresponding Korean Patent Application No. 10-2013-0161019.

*Primary Examiner* — Joseph L Perrin

(57) ABSTRACT

The present disclosure provides a drum type washing machine including a tub; a drum in the tub, configured to receive laundry; a motor coupled to the tub configured to rotate the drum; a spider configured to transfer torque from the motor to the drum, the spider including a shaft mount connected to a shaft of the motor, a plurality of arms radially extending from the shaft mount, and a plurality of supporting bars extending from the arms; a fixing member configured to fix or attach the drum to the spider; a plurality of slide guides in at least one of a side surface of the drum and the supporting bars; and a plurality of slide rails on another one of the side surface of the drum and the supporting bars, configured to be inserted into and/or slide along the slide guides, wherein the drum is movable in forward and backward directions of the tub.

19 Claims, 2 Drawing Sheets

(56) References Cited

U.S. PATENT DOCUMENTS

| | | | | |
|---|---|---|---|---|
| 2006/0254321 | A1 | 11/2006 | Lim et al. | |
| 2007/0261448 | A1 | 11/2007 | Ho et al. | |
| 2009/0211311 | A1* | 8/2009 | McMaster | D06F 37/02 68/133 |
| 2010/0116002 | A1 | 5/2010 | Meydanli | |

* cited by examiner

DRUM TYPE WASHING MACHINE

CROSS-REFERENCE TO RELATED APPLICATIONS

This application is based on and claims priority from Korean Patent Application No. 10-2013-0161019, filed on Dec. 23, 2013, the disclosure of which is incorporated herein in its entirety by reference.

TECHNICAL FIELD

The present disclosure relates to a drum type washing machine, and more particularly, to a drum type washing machine that is relatively easy to disassemble (e.g., removing a drum from a tub using a spider or other reversible securing device, in order to clean the drum), and to reassemble (e.g., securing the drum back on the spider).

BACKGROUND

In general, a drum type washing machine is designed to place laundry in the washing machine through a door at the front of the washing machine, and to wash the laundry using a relatively small amount of water and detergent.

The drum type washing machine includes a cabinet that forms the exterior of the washing machine, a tub in the cabinet configured to hold water, a rotatable drum in the tub to accommodate laundry, a motor in, behind or under the tub for rotating the drum, a water supply device for supplying water to the tub, and a drain for discharging the water from the tub to the outside of the cabinet after the washing operation is terminated.

The drum may be connected to a shaft of the motor via a spider. The spider is on a rear surface of the drum. The spider includes a shaft mount connected to the shaft and a plurality of arms that protrude from the shaft mount and are coupled to the rear surface of the drum. The drum is coupled to the spider at a plurality of points on its rear surface by screws or an adhesive. When the drum type washing machine washes laundry, the motor generates torque and the spider transfers the torque to the drum.

When the drum is contaminated with foreign substances or stains, the drum (e.g., inside or outside surfaces of the drum) may need to be cleaned. Since the drum is coupled to the spider at a plurality of points by screws or adhesive, it is relatively difficult to disassemble the drum from the spider. Also, after the drum is disassembled from the spider and cleaned, it may be difficult to reassemble the drum to the spider.

In addition, since the spider is coupled or attached to the rear surface of the drum, the torque generated by the motor may not be effectively transferred to the drum.

A conventional drum type washing machine may be disclosed in United States Patent Application Publication No. US 2006/0254321 A1.

SUMMARY

Embodiments of the present disclosure provide a drum type washing machine having a drum that can be readily disassembled from and reassembled in the washing machine. In addition, the drum type washing machine of exemplary embodiments may effectively transfer a torque from a motor to the drum.

Exemplary embodiments of the present disclosure provide a drum type washing machine comprising a tub; a drum in the tub configured to receive laundry; a motor coupled or attached to the tub, configured to rotate the drum; a spider configured to transfer torque the motor to the drum, the spider including a shaft mount connected to a shaft of the motor, a plurality of arms radially extending from the shaft mount, and a plurality of supporting bars extending forward from the arms; a fixing member configured to fix or attach the drum to the spider; a plurality of slide guides on a side surface of the drum or the supporting bars; and a plurality of slide rails on the other of the side surface of the drum and the supporting bars, configured to be inserted into and/or slide along the slide guides, wherein the drum is movable in forward and backward directions of the tub.

The fixing member may be coupled to the drum and the spider when a rear wall of the drum contacts the arms.

The plurality of arms and the plurality of supporting bars may be spaced apart or separated from one another in a radial and/or circumferential direction. The drum guides may be at locations corresponding to the locations of the supporting bars, and may be present in the same number as the number of the supporting bars.

The fixing member may comprise a rod having a cylindrical shape and a male screw thread; a flange having a diameter larger than that of the rod; and a knob on the flange, wherein a female screw thread is in a center of the rear surface of the drum and a center of the shaft mount, and the rod is screwed to the center of the rear wall of the drum and the center of the shaft mount.

The torque is transferred to the drum by an inner wall of the slide guide pushing a sidewall of the slide rail, or the sidewall of the slide rail pushing the inner wall of the slide guide.

According to embodiments of the present disclosure, since a user can easily or readily disassemble the drum from the washing machine and clean and reassemble the drum in the washing machine, the drum type washing machine may advantageously be maintained.

Also, according to embodiments of the present disclosure, the torque of the motor can be effectively transferred to the drum. As a result, the stability of the rotation of the drum may be improved.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
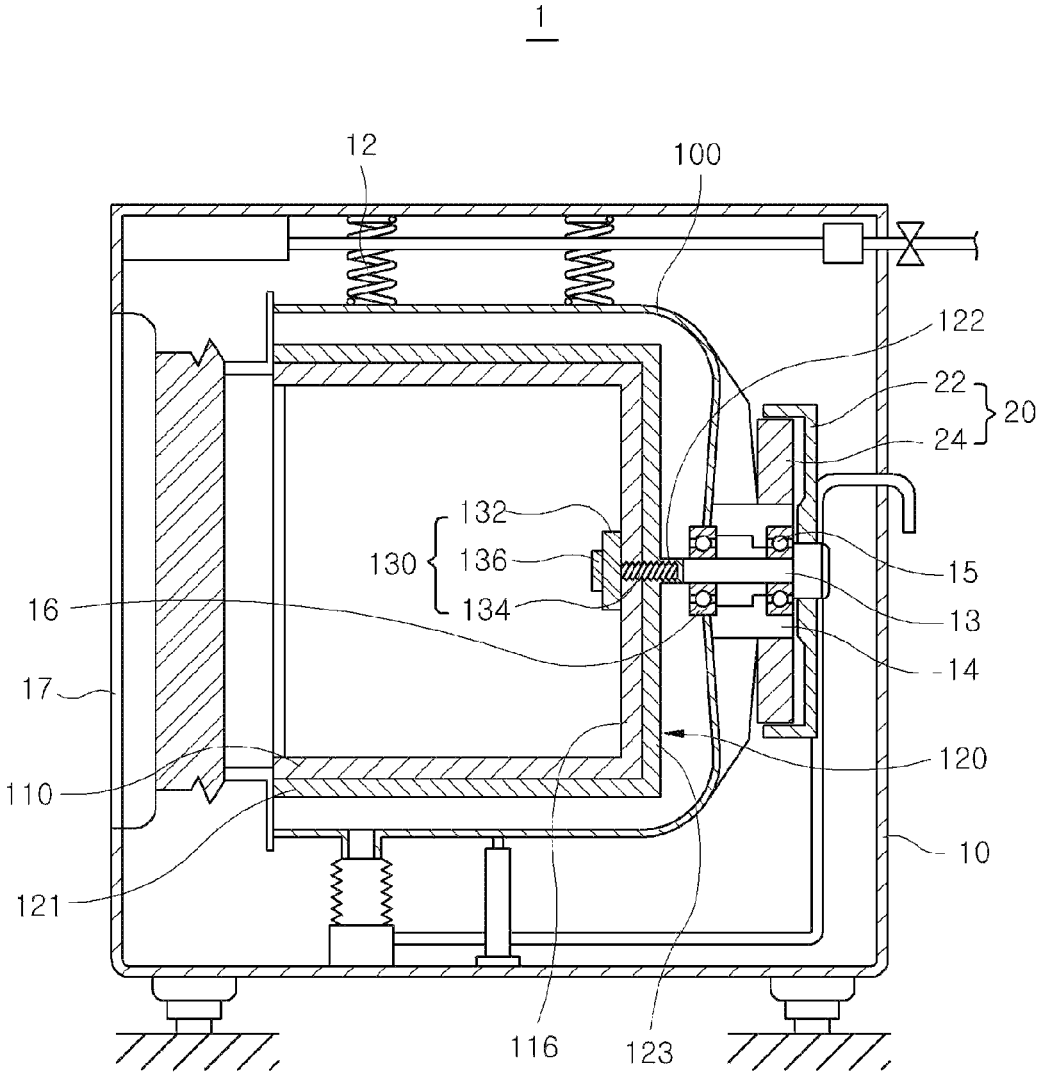
FIG. 1 is a cross-sectional view illustrating a drum type washing machine according to exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Exemplary embodiments of the present disclosure will be described more fully hereinafter with reference to the accompanying drawings, in which the exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplary and not limiting. The same reference numerals designate the same structures, elements, or parts illustrated in two or more drawings in order to exhibit the same or similar characteristics.

The disclosed exemplary embodiments of the present disclosure illustrate ideal embodiments of the present disclosure in more detail. As a result, various modifications of the drawings are expected. Accordingly, the exemplary embodiments are not limited to a specific form or illustrated region, and for example, include modifications a form (e.g., by manufacturing).

Hereinafter, exemplary embodiments will be described in detail with reference to the accompanying drawings.

A drum type washing machine 1 in accordance with exemplary embodiments of the present disclosure will be described with reference to FIG. 1 to FIG. 3. FIG. 1 is a cross-sectional view schematically illustrating a drum type washing machine according to exemplary embodiments of the present disclosure, FIG. 2 is a rear perspective view illustrating a drum coupled to a spider of the exemplary washing machine of FIG. 1, and FIG. 3 is a front view illustrating the drum coupled to the spider of the washing machine of FIG. 1.

Figure 2:
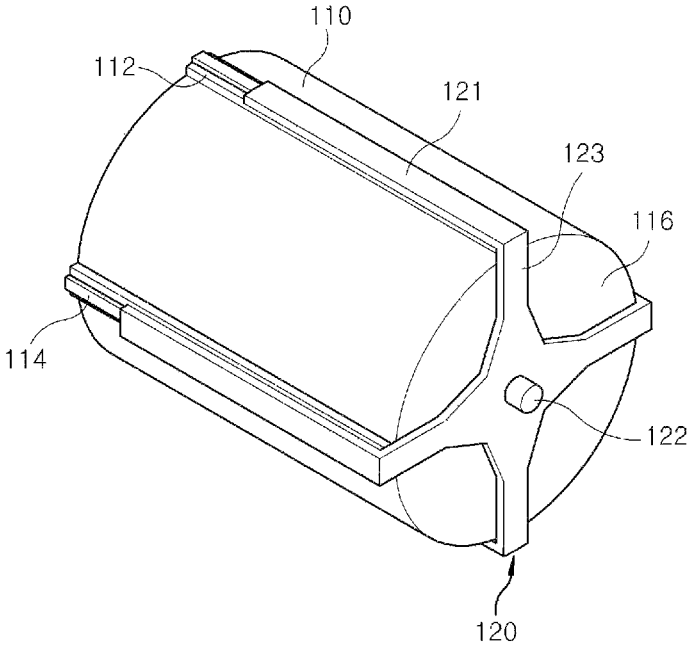
FIG. 2 is a rear perspective view illustrating a drum coupled to a spider of the exemplary washing machine of FIG. 1.
Figure 3:
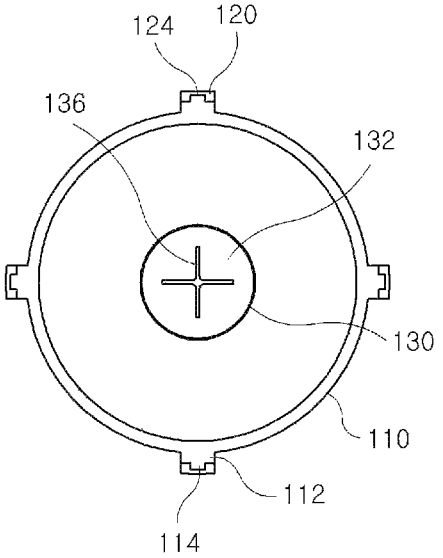
FIG. 3 is a front view illustrating the drum coupled to the spider of the exemplary washing machine of FIG. 1.

Referring to FIG. 1 to FIG. 3, the drum type washing machine 1 may include a cabinet 10 forming the exterior of the washing machine, a tub 100 in the cabinet 10 configured to receive water, a drum 110 in the tub 100 to receive laundry, a motor 20 on the tub 100 to provide torque to the drum 110, a spider 120 that includes a plurality of arms 123 radially extended from a shaft mount 122 and a plurality of supporting bars 121 extended forward from an end of the arm 123, a fixing member 130 that fixes or attaches the drum 110 to the spider 120, a plurality of slide guides 124 on one of a side surface of the drum 110 and the supporting bars 121, and a plurality of slide rails 114 the other one of the side surface of the drum 110 and the supporting bars 121, configured to be inserted into the slide guides 124.

The tub 100 has a cylindrical shape and a front side that is open, and is installed in the cabinet 10 using a plurality of hanger members 12 at an upper section of the cabinet 10, among other components within the washing machine 1. In the present embodiments, the hanger member 12 comprises, for example, a spring. Also, a door 17 that selectively opens or closes an opening of the tub 100 is at or on the front of the cabinet 10.

The motor 20 receives power from an outside source to generate the torque. The motor 20 is at a rear inner side of the cabinet 10, and includes a shaft 13, a rotor 22 coupled to the shaft 13, and a stator 24 inside the rotor 22. The motor may be coupled to a rear wall of the tub 100.

A front bearing 16 and a rear bearing 15 are coupled to an outer circumferential surface of the shaft 13, and a bearing housing 14 that supports the bearings 15 and 16 may be in a center of the rear wall of the tub 100.

The spider 120 includes the shaft mount 122 connected to the shaft 13, and arms 123 extending in a radial direction from the shaft 13 from the shaft mount 122.

The shaft mount 122 is coupled to the shaft 13, such that the shaft mount 122 rotates together with the shaft 13 when the shaft 13 rotates. When the shaft 13 rotates, the spider 120 also rotates together with the shaft 13. The shaft mount 122 and the shaft 13 are coupled to each other by welding, adhesive, screws, or a known coupling method that allows the shaft mount 122 and the shaft 13 to rotate together.

The plurality of arms 123 and the supporting bars 121 are spaced apart or separate from one another in a circumferential direction. The plurality of arms 123 and the plurality of supporting bars 121 comprise four arms 123 and four supporting bars 123, respectively. In the present embodiments, it is illustrated that four arms 123 and four supporting bars are at intervals of 90 degrees. However, the plurality of arms 123 and the plurality of supporting bars 121 may have a different number of arms and supporting bars. In addition, the plurality of arms 123 and supporting bars 121 may be at various angles. For example, there may be two arms oriented at 180 degrees with respect to each other, three arms at 120 degrees, five arms at 72 degrees, 6 arms at 60 degrees, etc.

The supporting bar 121 may extend in a direction perpendicular from the end of the radially extended arm 123. The slide guide 124 may be dented or have a notch or groove in an inner surface of the supporting bar 121 that extends in along the length of the supporting bar 121.

The drum 110 may have a cylindrical shape, a front side that is open, and includes therein a space for receiving laundry.

A plurality of drum guides 112 are on and/or connected to an outer circumferential surface of the drum 110. The drum guides 112 may protrude or extend at a predetermined height or distance from the outer circumferential surface of the drum 110 and may be at locations corresponding to the plurality of supporting bars 121. The drum guides 112 may be present in the same number as the supporting bars 121. Each of the supporting bars 121 is on each of the drum guides 112 when the spider 120 is coupled to the drum 110. Alternatively, some guides and some rails on the drum are complementary structures on or in the supporting bars 121.

Also, the slide rails 114 may be on the drum guides 112 and may protrude or extend from the drum guide 112. A width of the slide rail 114 may be narrower or smaller than that of the drum guide 112.

When the slide rails 114 of the drum 110 are in the slide guides 124 of the spider 120, the drum 110 is guided to a fixed location with the spider 120. The drum 110 is movable in forward and backward directions of the tub 100 along the slide rails 114.

When the slide rails 114 are in the slide guides 124 and a sidewall of the slide rail 114 contacts with an inner wall of the slide guide 124, the torque generated by the motor 20 is transferred to the drum 110 through the slide guides 124 and the slide rails 114. Thus, the torque generated by the motor 20 is transferred to the drum 110 by the inner wall of the slide guide 124, pushing the sidewall of the slide rail 114 and rotating the drum 110.

The exemplary embodiments include the slide rails 114 are on the drum guides 112 of the drum 110, and the slide guides 124 are on the supporting bars 121 of the spider 120. However, the present disclosure is not limited thereto. For example, it is also possible that the slide rails 114 are in the supporting bars 121 of the spider 120 and the slide guides 124 are in the drum guides 112 of the drum 110. In this case, the torque generated by the motor 20 may be transferred to the drum 110 by the sidewall of the slide rail 114 pushing the inner wall of the slide guide 124.

When the drum 110 moves to the fixed location (e.g., a location in which the rear wall 116 of the drum 110 contacts the arms 123 of the spider 120), the drum 110 may be fixed to the spider 120 by the fixing member 130.

In detail, the fixing member 130 may include a rod 134 having a cylindrical shape and a male screw thread, a flange 132 having a diameter larger than that of the rod 134, and a knob 136 on the flange 132. Also, a female screw thread may be at a center of the rear wall 116 and a center of the shaft mount 122, and the rod 134 may be screwed to the female thread of the center of the rear wall 116 and the female thread of the center of the shaft mount 122. Thus, the fixing member 130 may be coupled or attached to the drum 110 and the spider 120 when the rear wall 116 of the drum 110 contacts a front surface of the arm 123.

Now, operations and effects of the drum type washing machine 1 having the above configuration will be described in detail.

As power is supplied to the motor 20 from the outside source, the rotor 24 rotates and the shaft 13 coupled to the rotor 24 rotates. As the shaft 13 rotates, the spider 120 and the drum 110 connected to the shaft 13 also rotate. As a result, the torque generated by the motor 20 is substantially transferred to the drum 110 between the slide guides 124 and the slide rails 114.

The existing or conventional drum type washing machine is configured such that the spider is coupled only to the rear surface of a drum, and thus torque is delivered to the drum only through the rear surface. The drum type washing machine 1 according to exemplary embodiments of the present disclosure is configured such that the torque is also transferred through the outer circumferential surface of the drum 110. Therefore, the drum type washing machine 1 advantageously transfers the torque more stably than the existing drum type washing machine.

In addition, when the drum 110 is contaminated with foreign substances, mold, mildew, or stains, the drum 110 may be easily separated from the cabinet 10 to wash the drum 110. A user may hold and rotate the knob 136 of the fixing member 130 to separate or remove the fixing member 130 from the drum 110 and the spider 120, and then the drum 110 is easily disassembled from the spider 120 by sliding the drum 110 forward with respect to the spider 120. After disassembling the drum 110, the user can clean the drum 110.

After the drum 110 is cleaned, to reassemble the drum 110 to the spider 120, the user may insert the slide rails 114 of the drum 110 into the slide guides 124 of the spider 120 and push the drum 110 in a direction towards the spider 120 to allow the drum 110 to slide back with respect to the spider 120, thus contacting the rear wall 116 of the drum 110 with the arm 123. The user may insert the fixing member 130 into a hole at the center of the rear wall 116 of the drum 110 and rotate the fixing member 130, so that the fixing member 130 is inserted into the rear wall 116 of the drum 110 and the female thread is in the shaft mount 122.

Thus, the drum 110 and the spider 120 can be effectively couple to each other using the fixing member 130.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A drum type washing machine comprising:
a tub;
a drum in the tub, configured to receive laundry;
a motor coupled to the tub, configured to rotate the drum;
a spider configured to transfer torque from the motor to the drum, the spider including a shaft mount connected to a shaft of the motor, a plurality of arms radially extending from the shaft mount, and a plurality of supporting bars extending from the arms;
a fixing member configured to fix or attach the drum to the spider;
a plurality of drum guides disposed on an outer circumferential surface of the drum corresponding to locations of the supporting bars;
a plurality of slide guides on at least one of the drum guides and the supporting bars; and
a plurality of slide rails on another one of the drum guides and the supporting bars, configured to be inserted into and/or slide along the slide guides,
wherein the drum is movable in forward and backward directions of the tub along the side rails,
wherein the fixing member comprises:
a rod having a cylindrical shape and a male screw thread;
a flange having a diameter larger than that of the rod; and
a knob located on the flange,
wherein a female screw thread is in a center of the rear surface of the drum and a center of the shaft mount, and
wherein the rod is screwed to the center of the rear wall of the drum and the center of the shaft mount.

2. The drum type washing machine of claim 1, wherein the fixing member is coupled or attached to the drum and the spider, and a rear wall of the drum contacts the arm.

3. The drum type washing machine of claim 1, wherein the plurality of arms and the plurality of supporting bars are spaced apart from one another in a circumferential direction.

4. The drum type washing machine of claim 3, wherein the plurality of drum guides are on an outer circumferential surface of the drum.

5. The drum type washing machine of claim 4, wherein each of the plurality of drum guides protrude or extend at a predetermined height or distance from the outer circumferential surface of the drum.

6. The drum type washing machine of 5, wherein each of the drum guides have a first width and each of the slide rail has a second width narrower than the first width.

7. The drum type washing machine of claim 1, wherein the drum guides have the same number as the number of the supporting bars.

8. The drum type washing machine of claim 1, wherein the torque is transferred to the drum by an inner wall of the slide guide pushing a sidewall of the slide rail.

9. The drum type washing machine of claim 1, wherein the torque is transferred to the drum by the sidewall of the slide rail pushing an inner wall of the slide guide.

10. The drum type washing machine of claim 1, further comprising a front bearing and a rear bearing coupled to an outer circumferential surface of the shaft.

11. The drum type washing machine of claim 10, further comprising a bearing housing in a center of the rear wall of the tub, the bearing housing configured to support the front and rear bearing.

12. The drum type washing machine of claim 1, wherein the shaft mount is configured to rotate with the shaft when the shaft rotates.

13. The drum type washing machine of claim 1, wherein the shaft mount and the shaft are coupled to each other by welding, an adhesive, and/or screws.

14. The drum type washing machine of claim 1, wherein the plurality of arms comprises at least four arms.

15. The drum type washing machine of claim 14, wherein each of the plurality of arms are spaced apart at intervals of 90 degrees or less.

16. The drum type washing machine of claim 14, wherein the plurality of bars comprises at least four bars.

17. The drum type washing machine of claim 16, wherein each of the plurality of bars are spaced apart at intervals of 90 degrees or less.

18. The drum type washing machine of claim 17, wherein each of the plurality of supporting bars extend in a direction perpendicular to the plurality of radially extending arms.

19. The drum type washing machine of claim 1, wherein each of the plurality of slide guides comprise a dent, a notch or groove in an inner surface of the supporting bar that extends along the length of the supporting bar.

* * * * *